US006272687B1

(12) United States Patent
Cunningham

(10) Patent No.: US 6,272,687 B1
(45) Date of Patent: Aug. 14, 2001

(54) PUNCTURE PROOF SURGICAL GLOVES

(76) Inventor: Frank W. Cunningham, 26606 Menominee Pl., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/502,836

(22) Filed: Feb. 11, 2000

(51) Int. Cl.[7] ..... A41D 19/00
(52) U.S. Cl. ..... 2/161.7; 2/16; 2/169; 428/911
(58) Field of Search ..... 2/16, 159, 161.6, 2/161.7, 161.8, 163, 164, 167, 168, 169; 428/911, 297.1

(56) References Cited

U.S. PATENT DOCUMENTS

| | | | | |
|---|---|---|---|---|
| 5,548,844 | * | 8/1996 | Ceresia | 2/161.7 |
| 5,601,895 | * | 2/1997 | Cunningham | 428/66.6 |
| 5,817,433 | * | 10/1998 | Darras | 428/911 |
| 5,960,470 | * | 10/1999 | Bachner, Jr. | 2/2.5 |
| 5,976,996 | * | 11/1999 | Howland | 442/189 |
| 6,020,057 | * | 1/2000 | Darras | 428/323 |
| 6,044,493 | * | 4/2000 | Post | 2/167 |
| 6,081,927 | * | 7/2000 | Gimbel | 2/161.7 |

* cited by examiner

*Primary Examiner*—John J. Calvert
*Assistant Examiner*—Katherine Moran
(74) *Attorney, Agent, or Firm*—Lee W. Tower

(57) ABSTRACT

A puncture proof surgical glove and methods for producing the puncture proof glove are provided. The puncture proof glove provides flexibility and elasticity and protects against dangerous puncture wounds from needles and scalpels. The puncture proof surgical glove includes a first glove and second glove that each include a first pattern cut from a first material in a shape, a first layered stack of a plurality of patterned sheets, each of the plurality of patterned sheets cut from a second material in the first shape and having multiple line cuts through the second material, a second pattern cut from the first material in the first shape, and a third pattern cut in the first shape. The first pattern is layered on top of the first layered stack and the second pattern is layered on the bottom of the first layered stack and the first pattern and second pattern are bonded along their edges. The third pattern is then bonded to the edge of the bonded first and second patterns along an edge of the third pattern except for a portion of the edge to provide for an opening. The second glove is placed over the first glove so that the third pattern of the second glove is layered on top of the first pattern, and the bonded edge of the second glove overlaps the bonded edge of the first glove. Then the third pattern of the second glove is bonded to the first pattern of the first glove.

24 Claims, 17 Drawing Sheets

WHEREIN EACH PATTERNED SHEET HAS AN ALTERNATING PATTERN OF FIRST AND SECOND CUTS THROUGH THE SECOND MATERIAL THE FIRST CUTS BEING ORIENTED NINETY DEGREES TO THE SECOND CUTS

240

FIG. 22

WHEREIN EACH PATTERNED SHEET HAS A HERRINGBONE PATTERN OF CUTS THROUGH THE SECOND MATERIAL

242

FIG. 23

PUNCTURE PROOF SURGICAL GLOVES

BACKGROUND OF THE INVENTION

1. Field of the Invention

This invention relates to a protective puncture proof material and more particularly to a flexible puncture proof material to protect against accidental injuries from needles, scalpel blades, knives and other sharp pointed instruments.

2. Description of the Related Art

Protection from accidental cuts and punctures is needed in the fields of medicine and law enforcement, and in any occupation where sharp instruments are encountered and where the combination of flexibility and protection against cuts and puncture wounds is needed.

Accidental needle sticks and scalpel blade cuts occur to doctors and nurses, while performing surgery, giving injections, taking blood samples, and administering intravenous liquids. The accidental needle sticks and scalpel blade cuts by themselves are harmful; however, in a medical situation a cut or puncture can also transmit infection either to the patient or to the medical person performing the procedure.

In the past, the main concern was that a surgeon would infect the patient during surgery. This is still a concern and is adequately addressed by using latex gloves. Unfortunately, it is also increasingly crucial to protect surgeons and other medical personnel from infection. A surgeon can contract hepatitis, AIDS, and other diseases, when the blood or body fluid of a patient is transmitted through the skin of the surgeon. It is estimated that the average surgeon has about three cuts or puncture wounds per month, caused by either a hypodermic needle or a scalpel blade. This presents an unacceptable risk factor for surgeons and other medical personnel.

The CDC (Centers for Disease Control and Prevention) has estimated the number of percutaneous (through the skin) injuries per year in the United States. Each year there are 30 reported injuries per 100 occupied hospital beds. Since there are 600,000 occupied hospital beds in the United States, there are 180,000 reported percutaneous injuries reported per year. In addition the CDC estimates that 39% of the incidents are not reported according to survey conducted. Also, the CDC doubles the resulting figure because 50% of healthcare workers are employed outside of hospital settings. The total estimated number of percutaneous injuries per year is 590,194.

The risks of infection following a single HIV (human immunodeficiency virus), HBV (hepatitus B virus), or HBC (hepatitus C virus) contaminated needlestick or sharp instrument injury are 0.3%, 6%–30%, and 1%–10%, respectively. Clearly surgeons and other health care workers are facing a high risk of infection from needlesticks and other sharp instruments.

Conventionally, surgeons and other medical personnel wear sterilized latex gloves, which are thin and flexible enough to enable a surgeon to freely manipulate his fingers, and to utilize his sense of touch. If the latex gloves are not penetrated then the patient and the surgeon are protected from infection; however, latex gloves offer hardly any protection against accidental punctures or cuts, because hypodermic needles and scalpel blades can easily puncture or cut through a latex glove. Even multiple layers of latex gloves, which medical personnel increasingly use to provide additional protection against transmission of infection, offer no protection against accidental punctures or cuts.

It is important to distinguish between cuts and puncture wounds. A cut is typically from the edge of a scalpel blade. A puncture wound can be caused by the point of a scalpel blade or by the point of a hypodermic needle. A scalpel blade is typically about 0.75 inches long with a sharpened edge and with a point about 0.010 inches in diameter. A hypodermic needle can be as small as 0.010 inches in diameter at the point widening to about 0.018 inches in diameter for the shaft of a No. 27 needle. It is much easier to protect against a cut from an edge of a scalpel blade than to protect against a puncture from either a scalpel blade or a hypodermic needle, because a scalpel blade has a wider surface upon which the pressure of the cut is distributed. For example, if the pressure is 2000 grams, then the pressure per square area for a scalpel blade is 2000/(0.75*0.010), assuming the edge of the scalpel blade is the same sharpness as the point of the scalpel blade (0.010 inches) and that the scalpel blade is 0.75 inches long. For a needle with a 0.010 diameter point the same pressure would have a pressure per square area of $2000/(3.14*(0.010/2)^2)$, which is ninety five times greater than the pressure per square area for the edge of a scalpel blade. This factor of approximately one hundred is a key reason that conventional protective gloves fail to offer adequate protection against punctures.

Most accidents in the operating room occur with some significant force. For example, a surgeon turns and is wounded accidentally by the point of a needle or scalpel being handed to him by a nurse or, a surgeon while suturing slips and punctures his hand with a needle. Effective protection against punctures should protect against pressures up to approximately 1500 to 1800 grams. This level of protection is well beyond the protection provided by the conventional puncture resistant gloves.

Conventional approaches to providing increased protection beyond latex gloves against cuts and punctures for a surgeon or other medical personnel include: providing a glove with a weave or knit of a material such as Kevlar, nylon, stainless steel or fiberglass; providing reinforced areas such as on glove fingers; placing foam material between two latex gloves; and providing leather on portions of the glove. Some of the materials, such as leather and Kevlar knits provide protection against cuts, but virtually no protection against punctures.

Conventional protective gloves having a weave or knit of a material such as Kevlar, nylon, stainless steel or fiberglass are characterized by U.S. Pat. Nos. 4,526,828, 5,070,540, 4,833,733, 5,087,499, 4,742,578, and 4,779,290. These approaches have fairly effective protection against cuts, because a material such as a Kevlar weave is hard to cut through. However, a shortcoming of all of these approaches is that the weave or knit is simply spread apart by the wedge on a needle or scalpel point to form a passage as the needle or scalpel point is inserted into the material. Making the weave tighter or thicker does not prevent punctures; moreover, a thicker or tighter weave significantly reduces the flexibility of these gloves and their usefulness. As the number of layers or the thickness of the material increases, the ability of a surgeon to freely manipulate his fingers, and to utilize his sense of touch is significantly reduced.

Conventional protective gloves providing reinforced areas are characterized by U.S. Pat. No. 4,865,661, which has woven fiberglass placed at certain areas on the fingers of a glove and U.S. Pat. No. 5,187,815, which has corrugated metal foil in areas to be reinforced. The shortcoming of these approaches is that the reinforced areas have little flexibility so can only be placed on certain areas, which leaves the rest of the glove without the same protection. Also, even woven fiberglass and corrugated metal may be punctured. The point of a #11 blade will easily pass through metal foil ½ to 1 mil thick.

The approach of placing foam material between two latex layers is the approach of U.S. Pat. No. 4,901,372, which provides little if any protection against cuts and punctures, because the latex and the foam can be easily cut and punctured.

Providing leather on a glove is an approach that provides some protection to cuts; however, little protection to punctures. Even though the pores of the leather may be smaller than the diameter of a needle, a needle will simply make a hole in the leather as it passes through.

A flexible puncture proof material is described in U.S. Pat. No. 5,601,895 issued to Frank W. Cunningham, M. D. on Feb. 11, 1997, which solves some but not all of the above problems. This device proved to have excellent resistance to puncture and good flexibility, but no elasticity, and fell far short of the extreme performance requirements for a puncture proof surgical glove. These requirements are: 1. absolute maximal flexibility; 2. conformability to compound curves; 3. elasticity; and 4. the thinnest possible puncture resistant material, for tactile transmission/touch perception.

Accordingly, there is a need in the art for puncture proof surgical gloves and puncture proof material that is flexible and protects against accidental injuries from needles, scalpel blades and other sharp pointed instruments.

SUMMARY OF THE INVENTION

It is an object of this invention to provide a puncture proof surgical glove and also to provide methods for producing the puncture proof glove. The puncture proof glove provides flexibility and elasticity and protects against dangerous puncture wounds from needles and scalpels. The puncture proof surgical glove includes a first glove and second glove that each include a first pattern cut from a first material in a shape, a first layered stack of a plurality of patterned sheets, each of the plurality of patterned sheets cut from a second material in the first shape and having multiple line cuts through the second material, a second pattern cut from the first material in the first shape, and a third pattern cut in the first shape. The first pattern is layered on top of the first layered stack and the second pattern is layered on the bottom of the first layered stack and the first pattern and second pattern are bonded along their edges. The third pattern is then bonded to the edge of the bonded first and second patterns along an edge of the third pattern except for a portion of the edge to provide for an opening. The second glove is placed over the first glove so that the third pattern of the second glove is layered on top of the first pattern, and the bonded edge of the second glove overlaps the bonded edge of the first glove. Then the third pattern of the second glove is bonded to the first pattern of the first glove.

It is another objective of this invention to provide new puncture proof materials for preventing puncture wounds. Specifically, the invention provides a layered stack of patterned sheets that is puncture proof. The pattern on the sheets can take many forms of multiple line cuts through the pattern sheet material, which can be plastic or metal foil, or any other composite material. The pattern of cuts can be multiple parallel line cuts, cuts with alternating horizontal and vertical line cuts, and/or cuts in a herringbone pattern. Other patterns of cuts are also within the scope of the invention, including cuts with curves, which are also lines. Layers of these patterned sheets provide protection from sharp objects penetrating a particular layer or entering a cut of a particular layer.

Another form of layered stack has woven strips for each layer to provide a puncture proof barrier to needles and scalpels.

Other objects and many of the attendant features of this invention will be more readily appreciated as the same becomes better understood by reference to the following detailed descriptions and considered in connection with the accompanying drawings in which like reference symbols designate like parts throughout the figures.

BRIEF DESCRIPTION OF THE DRAWINGS

FIGS. 20 to 24 are flow diagrams of methods for producing a puncture proof surgical glove in accordance with the present invention.

DETAILED DESCRIPTION

Figure 1:
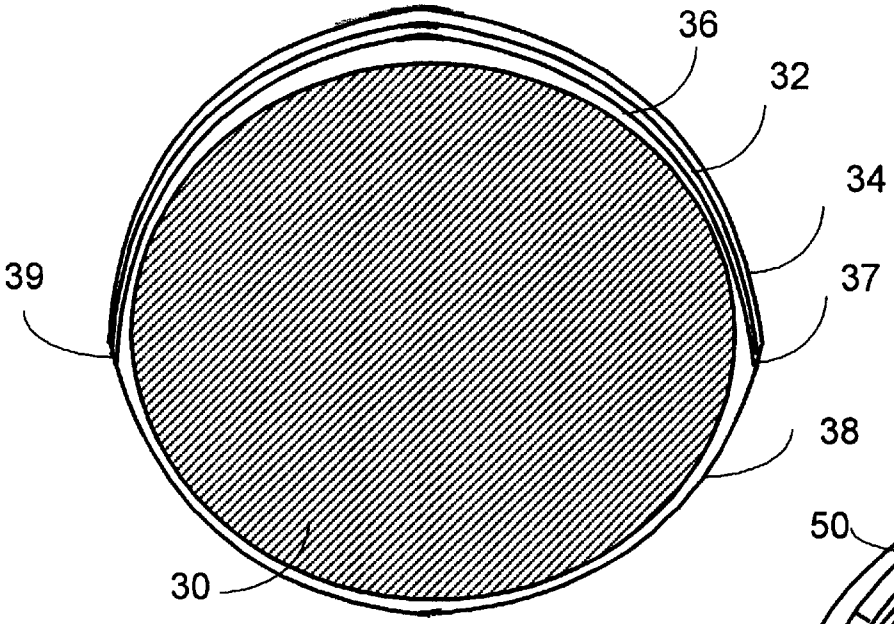
FIG. 1 is a cross section of an inner glove placed on a form for providing a puncture proof surgical glove in accordance with the present invention.
Figure 3:
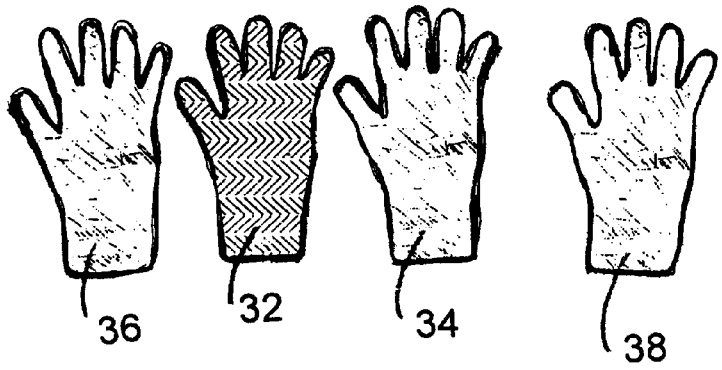
FIG. 3 shows a number of hand shaped pattern pieces used for providing a puncture proof surgical glove in accordance with the present invention.

Referring now to the drawings, FIG. 1 shows a cross section of an inner glove placed on a form 30 for providing a puncture proof surgical glove. The form can be of a hand or a portion of a hand. The form can also be for another portion of the body to be protected. Referring now to FIG. 3, patterns are shown for forming an inner glove in the shape of a hand. Pattern piece 36 is cut in the shape of a hand from light nylon knit material. Overlaying pattern piece 36 is layered stack 32, which has layers of hand shaped patterned sheets cut from a material such as plastic or metal foil. The number of layers various depending on the material selected and the thickness of each layer also varies depending on the material. The properties of the patterned sheets are described further below. Pattern piece 34 is also cut in a shape of a hand from light nylon knit material, and is overlaid on top of layered stack 32. The edges of patterned piece 36 are attached to the edges of patterned piece 34 by either sewing the edges together or bonding the edges together along seams 37 and 39. The layered stack 32 is effectively bagged between pattern piece 36 and pattern piece 34. The inner glove is completed by attaching the edge of pattern piece 38, shown in FIG. 3 and FIG. 1, to the bonded edges of pattern piece 36 and pattern piece 34, except for an opening, which is left for the hand to enter the glove. The pattern piece 38 can also be cut into shape of a hand from light nylon knit material. The inner glove has a puncture proof dorsal (top of hand) pattern.

Figure 2:
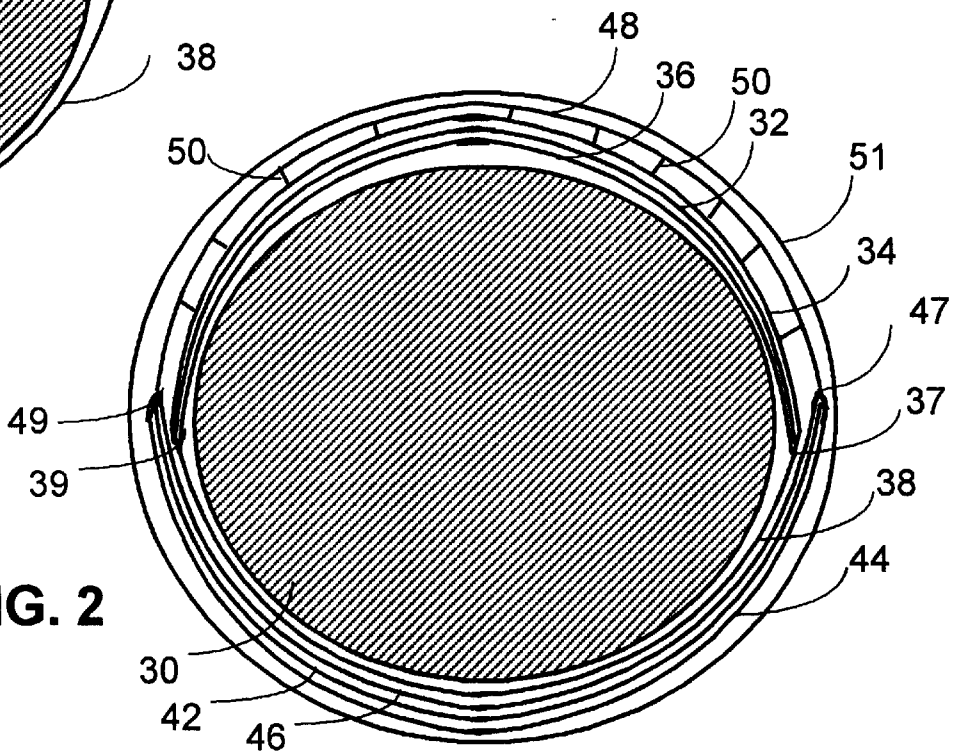
FIG. 2 is a cross section of an outer glove in place over an inner glove on a form for providing a puncture proof surgical glove in accordance with the present invention.

An outer glove with a puncture proof volar (bottom of hand) pattern is formed in a similar manner and placed over the inner glove as shown in FIG. 2. As shown in FIG. 2, the inner glove with pattern pieces 36 and 34 bonded along the edges 39 and 37 and bonded along that edge to pattern piece 38, except for an opening for the hand to enter is placed on form 30. The outer glove consists of pattern piece 46, which is cut in the shape of a hand from light nylon knit material. Overlaying pattern piece 46 is layered stack 42, which has layers of hand shaped patterned sheets cut from a material such as plastic or metal foil. The patterned sheets are made of the same material as the material used for the patterned sheets of layered stack 32. Pattern piece 44 is also cut in a shape of a hand from light nylon knit material, and is overlaid on top of layered stack 42. The edges of patterned piece 46 are attached to the edges of patterned piece 44 by either sewing the edges together or bonding the edges together along seams 47 and 49. The layered stack 42 is effectively bagged between pattern piece 46 and pattern piece 44. The inner glove is completed by attaching the edge of pattern piece 48 to the bonded edges of pattern piece 46 and pattern piece 44, except for an opening, which is left for the hand to enter the glove. The pattern piece 48 can also be cut into shape of a hand from light nylon knit material. The outer glove has a puncture proof volar (bottom of hand) pattern.

It is important that the edges of the inner glove overlap the edges of the outer glove so that the combination of inner glove and outer glove are puncture proof. As shown in FIG. 2, the bonded edges 47 and 49 of the outer glove overlap the edges 37 and 39 of the inner glove. The result is that layered stack 42 overlaps layered stack 32. To maintain the proper orientation of the inner glove to the outer glove, pattern piece 48 is attached to pattern piece 34 by either sewing or bonding pattern piece 48 to pattern piece 34 at selected points 50. The bonded points 50 keep the inner or outer glove from rotating with respect to each other in a manner that would expose a non-puncture proof seam. Once the inner glove has been attached to the outer glove, then a puncture proof glove is obtained.

The puncture proof glove can be used as an under glove. A standard latex sterile glove 51, as shown in FIG. 2 is worn over the puncture proof glove. The puncture proof glove can also be sterilized to prevent contamination of the surgical field if a needle pierces the latex glove (but not the puncture proof under glove).

Figure 4:
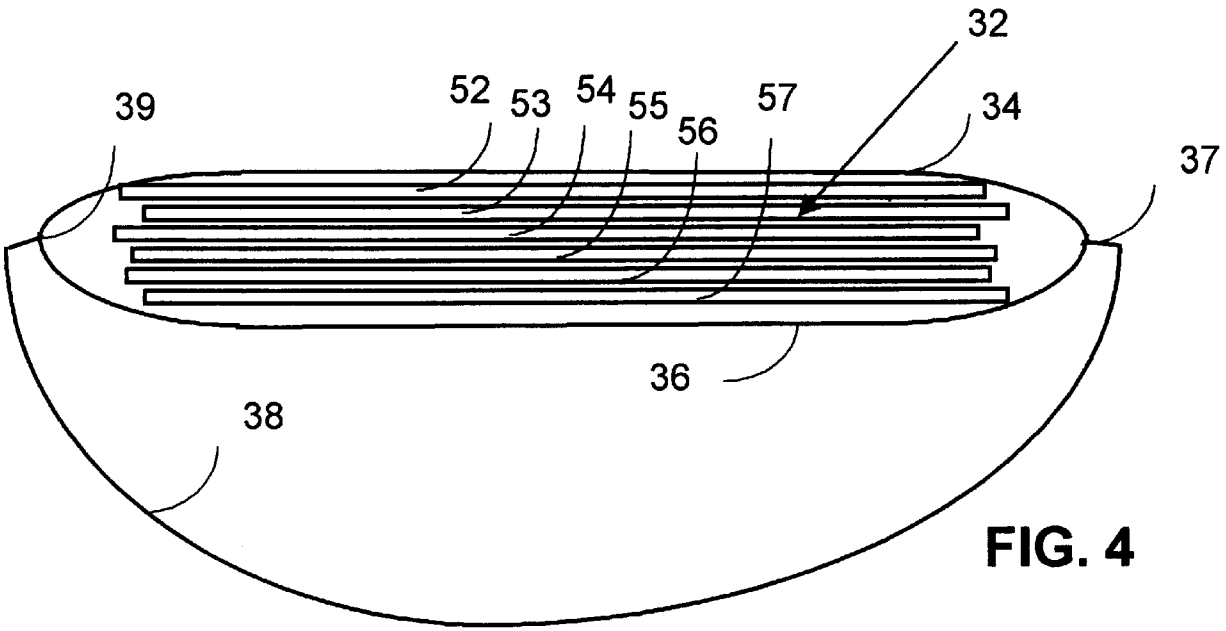
FIG. 4 is a detail of a cross section of an inner or outer glove for a puncture proof surgical glove in accordance with the present invention.

FIG. 4 is a detail of a cross section of the inner glove. An outer glove has essentially the same cross section. As shown the layered stack 32 includes patterned sheets 52, 53, 54, 55, 56, and 57, which are the effectively bagged between pattern piece 34 and pattern piece 36. As discussed above, the number of layers of patterned sheets varies depending on the material used. As shown in FIG. 4, the patterned sheets are not attached in any way to one another. It is important to emphasize that none of the patterned sheets are secured, glued, or bonded to each other. The reason for not attaching the patterned sheets to one another is that if the patterned sheets were attached to one another, then the patterned sheets would be prevented from sliding over one another, which is an essential property needed for flexibility and elasticity.

The patterned sheets are held in place by pattern piece 34 and pattern piece 36, which are sewn or bonded together at 30 edges 37 and 39. The hand shaped layered stack 32, as shown in FIG. 3, is held or effectively bagged between the hand shaped pattern pieces 34 and 36. The layered stack is also held in place by compressive forces produced by the tension between the fabric and the hand. Other shapes of pattern pieces and layered stacks are also possible.

Figure 5:
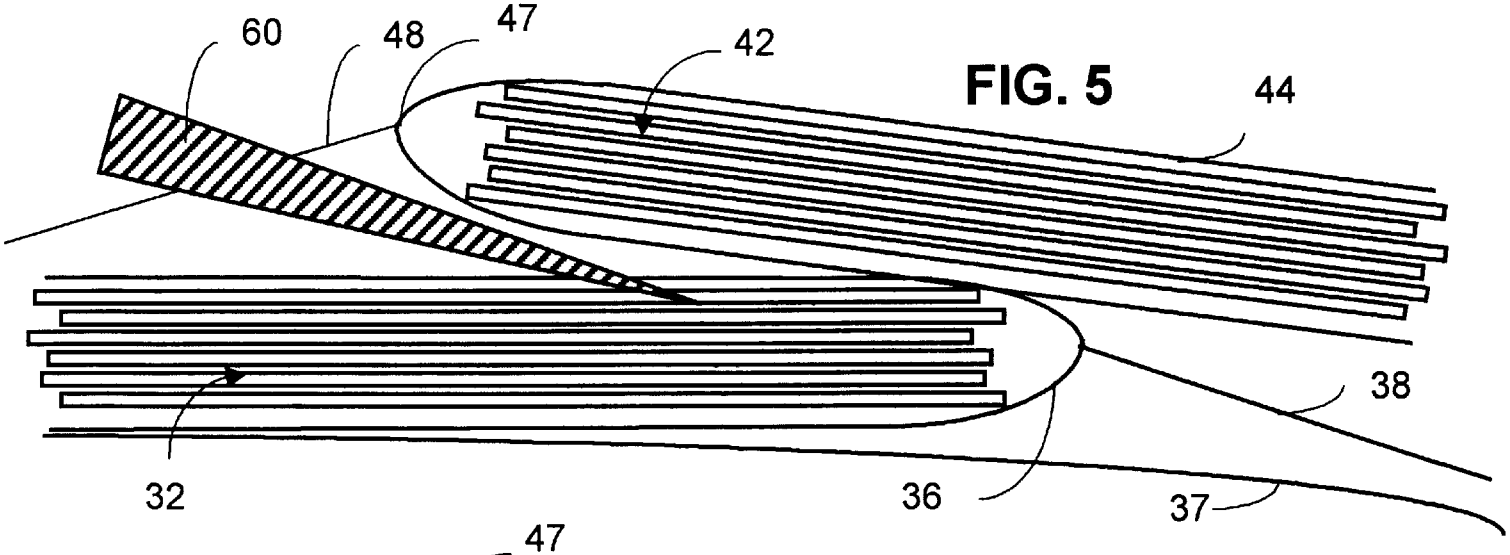
FIGS. 5 and 6 show details of an overlapped section of the inner and outer gloves for a puncture proof surgical glove and how the overlap stops a puncture in accordance with the present invention.
Figure 6:
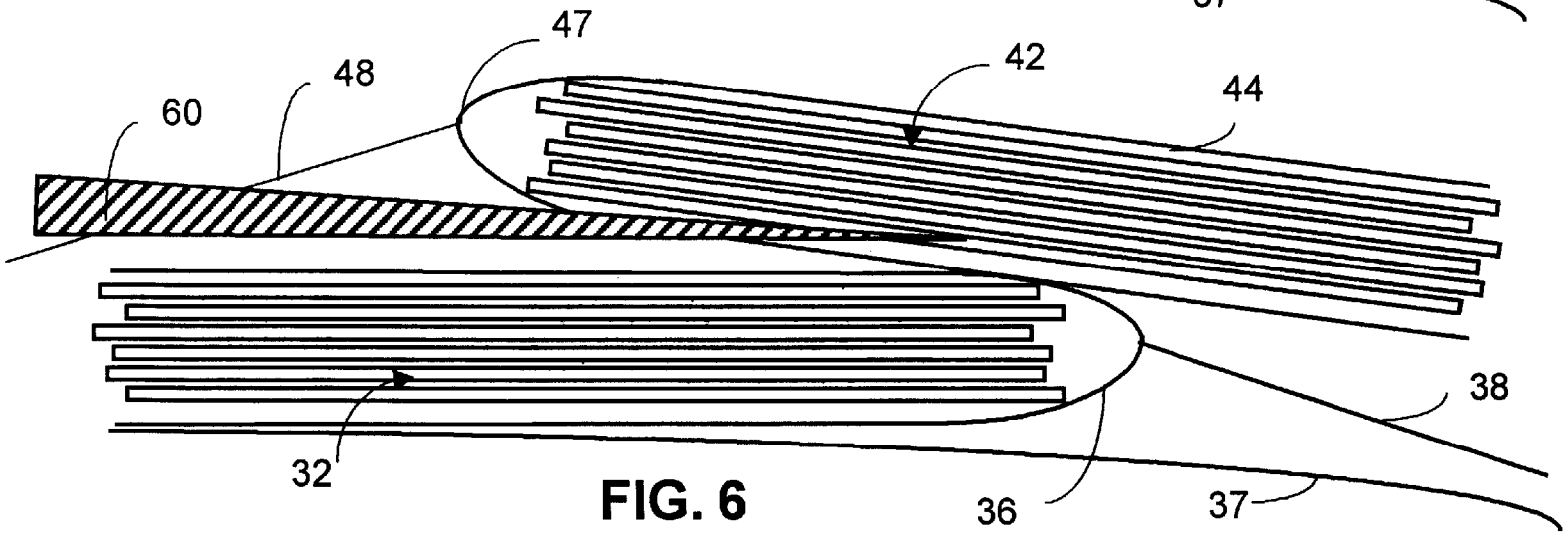

FIGS. 5 and 6 show details of an overlapped section of the inner and outer gloves and how the overlap stops a puncture. In FIG. 5 needle 60 is shown being intercepted and stopped by the stacked layer 32 of the inner glove; thus, not encountering the skin of the hand 37. If the needle 60 enters the seam at an even more extreme angle, then FIG. 6 shows how the needle encounters and is stopped by stacked layer 42 of the outer glove, again not encountering or puncturing the skin of the hand 37. Overlapping stacked layer 32 with stacked layer 42 provides for the puncture proof seam.

Various materials and numbers of patterned sheets can be used for the stack layers. The patterned sheets can also have various patterns of lines cut through the material, which can be straight or curved lines. By cutting lines through the material in various patterns the patterned sheets can be given an elastic property, which is important for sensitive surgical procedures.

Figure 10:
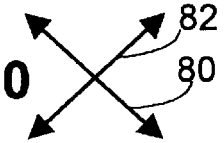
FIG. 10 illustrates that the layered patterned sheets of FIG. 9 have elasticity in the 45-degree axis in accordance with the present invention.
Figure 7:
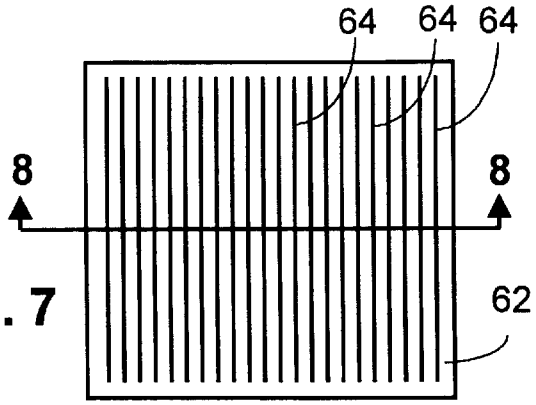
FIG. 7 is a portion of a patterned sheet having multiple parallel cuts through the patterned sheet for use in a puncture proof surgical glove in accordance with the present invention.
Figure 8:
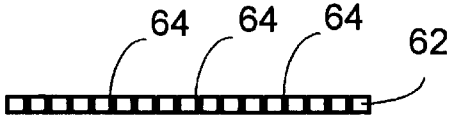
FIG. 8 is a section along line 8—8 of FIG. 7 showing a portion of a patterned sheet having multiple parallel cuts for use in a puncture proof surgical glove in accordance with the present invention.
Figure 9:
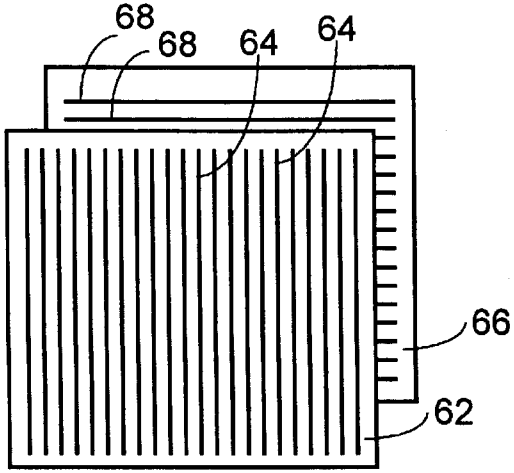
FIG. 9 shows the layering of the patterned sheets of FIG. 7 having multiple parallel cuts wherein each succeeding patterned sheet has multiple parallel cuts oriented at ninety degrees to the preceding patterned sheet for use in a puncture proof surgical glove in accordance with the present invention.

FIG. 7 is a portion of a patterned sheet 62 having multiple parallel cuts 64 through the patterned sheet. This can be called the strips pattern. FIG. 8 is a section along line 8—8 of FIG. 7 showing a portion of the patterned sheet 62 having multiple parallel cuts 64 through the patterned sheet. Alternating layers of the patterned sheets are stacked as shown in FIG. 9, which has patterned sheet 62 with vertical multiple parallel cuts 64 stacked on top of patterned sheet 66 with horizontal multiple parallel cuts 68. Alternating patterned sheets with horizontal and vertical cuts provides the stacked layer with elasticity at 45 degree angles to the cuts as shown in FIG. 10 directions 80 and 82. By layering the strips pattern sheets into a stacked layer, a puncture proof glove can be provided as described above.

Figure 13A:
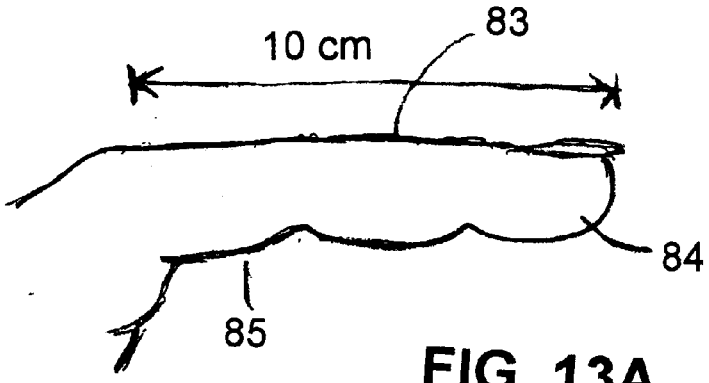
FIG. 13A shows an extended finger and corresponding
Figure 14A:
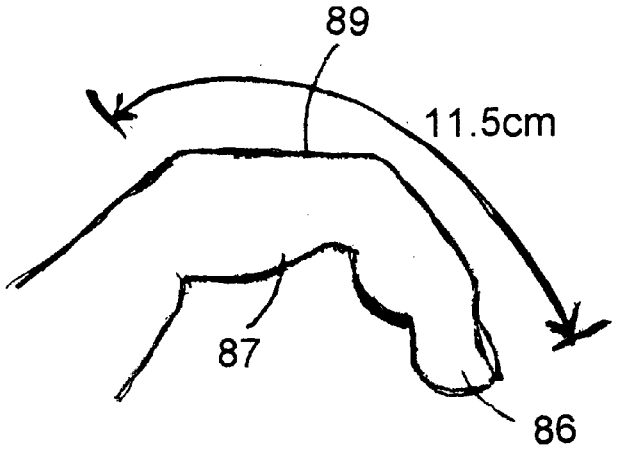
FIG. 14A shows a bent finger and corresponding
Figure 14B:
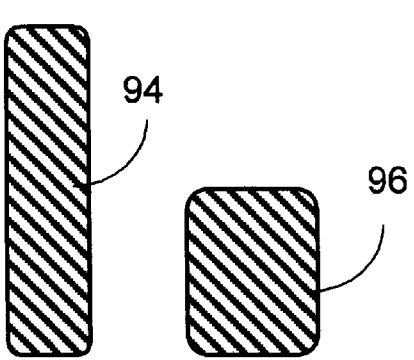
FIG. 14B shows how the dorsal portion elongates while the volar portion relatively shortens and widens to provide relief for the bending of a finger within a puncture proof surgical glove in accordance with the present invention.
Figure 13B:
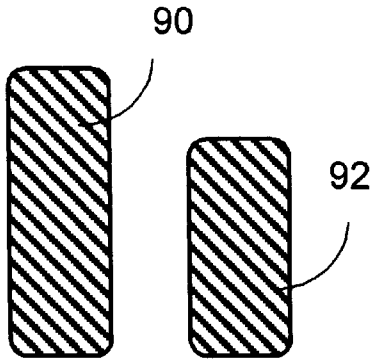
FIG. 13B shows a dorsal and volar portion of a puncture proof surgical glove.
Figure 11:
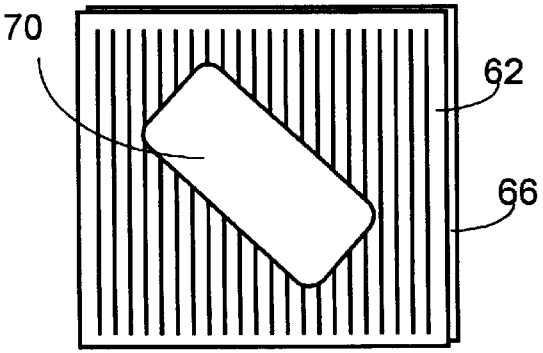
FIG. 11 illustrates cutting a portion of the layered patterned sheets of FIG. 9 at a 45-degree angle for use in a puncture proof surgical glove in accordance with the present invention.

FIG. 11 illustrates cutting a portion of stacked layer 70 from the layered patterned sheets of FIG. 9 at a 45-degree angle for use in a puncture proof surgical glove. By cutting the stacked layer at a 45 degree angle to the cuts, elasticity can be obtained along the length of the stacked layer portion 70. FIG. 13A shows an extended finger and FIG. 14A shows a bent finger. As shown in FIG. 13A and FIG. 14A, the top of a bent finger is approximately 15 percent longer than the top of an extended finger. By cutting the stacked layer at a 45 degree angle, as shown in FIG. 11, so that the length of the pattern 70 is aligned with the top of a finger or other surface which increases in length, elasticity of the stacked layer provides the relief necessary for the surgeon to properly move his/her hand. Flexibility is also provided because the volar portion 85 of an extended finger shown in FIG. 13A shortens in length, when bent as shown by 87 of FIG. 14A, while the dorsal portion 83 of the extended finger of FIG. 13A extends in length while bending, as shown by dorsal portion 89 in FIG. 14A. FIG. 13B shows a dorsal 90 and volar 92 portion of a puncture proof surgical glove as they would be when the finger is extended as in FIG. 13A. FIG. 14B shows how the dorsal portion 94 elongates while the volar portion 96 shortens and widens relative to 90 and 92 of FIG. 13B, respectively, to provide relief for the bending of a finger within a puncture proof surgical glove.

Figure 12:
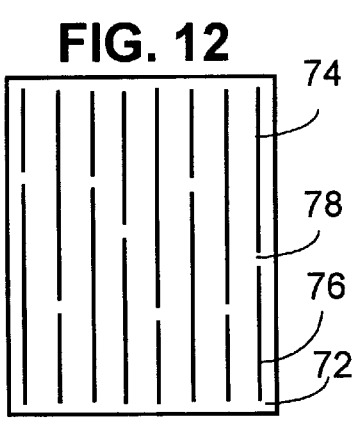
FIG. 12 shows a portion of a patterned sheet cut similar to FIG. 7, wherein a cut has gaps that provide bridges for stability for use in a puncture proof surgical glove in accordance with the present invention.
Figure 15C:
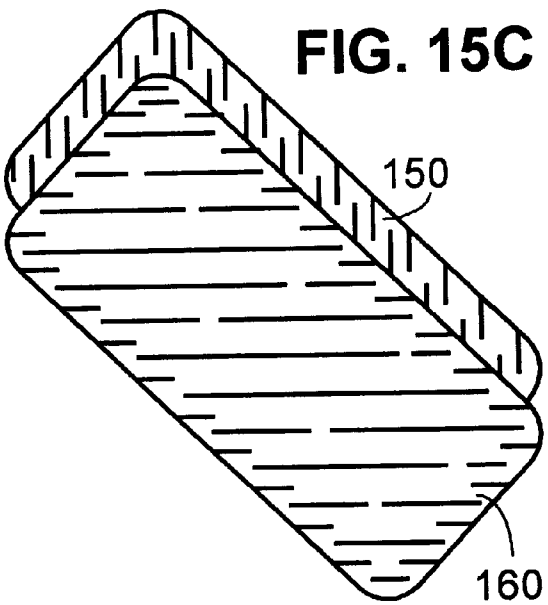
FIG. 15C shows alternating layers of patterned sheets that have vertical and horizontal cuts for use in a puncture proof surgical glove in accordance with the present invention.
Figure 15B:
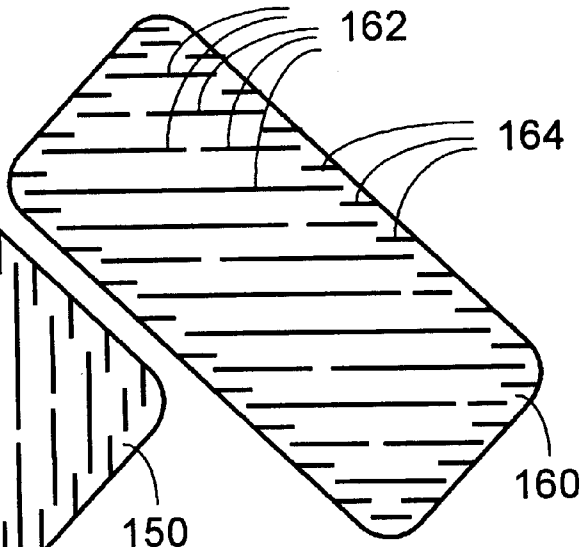
FIGS. 15A and 15B show patterned sheets having vertical and horizontal cuts, respectively through the patterned sheets wherein there are uncut gaps between horizontal or vertical cuts that provide bridges for stability and wherein the edges of the patterned sheets have cuts that provide additional elasticity and stability at the edges for use in a puncture proof surgical glove in accordance with the present invention.
Figure 15A:
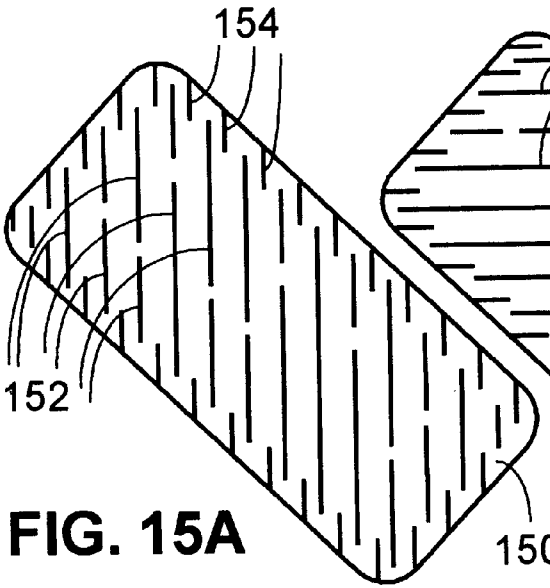

If the cuts are quite long in the strips pattern, then a strip could slide over an adjacent strip. Additional stability can be provided as shown in FIG. 12, which shows a patterned sheet 72 having multiple parallel cuts with uncut gaps or bridges of material 78 between vertical cuts 74 and 76. The bridges 78 between multiple cuts can be randomly distributed to provide stability and prevent sliding of adjacent strips. This pattern can be called a linked strips pattern. FIGS. 15A and 15B show patterned sheets having vertical 152 and horizontal 162 cuts, respectively, through the patterned sheets wherein there are uncut gaps between the horizontal or vertical cuts to provide stability. FIG. 15C shows alternating patterned sheets layered so that cuts of alternating layers have vertical and horizontal cuts. This provides elasticity in the 45 degree axis as described above. By layering the linked strips pattern sheets into a stacked layer, a puncture proof glove can be provided as described above.

A pattern cut from the middle of a patterned sheet 62 as shown in pattern 70 of FIG. 11 would have little stability because the edges of the strips are not attached and could easily slide over one another. The patterns in FIGS. 15A and 15B provide stability along the edge of the pattern while at the same time providing for flexibility and elasticity along the edge of pattern. These properties are provided by cuts 154 along the edge of the pattern of FIG. 15A and the cuts 164 along the edge of the pattern of FIG. 15B. These cuts allow the edges to expand while the same time providing stability to the edges. The short cuts 154 and 164 are aligned vertically and horizontally, corresponding to the vertical 152 and horizontal 162 cuts in pattern sheets 150 and 160, respectively. This pattern with edge relief can be called an edge relief linked strips pattern. By layering the edge relief linked strips pattern sheets into a stacked layer with alternating horizontal and vertical cuts on succeeding sheets, a puncture proof glove can be provided as described above.

Figure 16B:
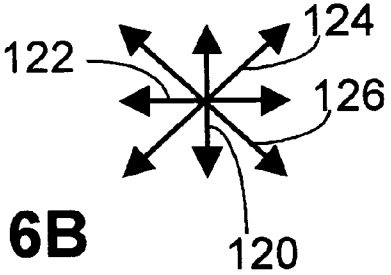
FIG. 16B shows that the material of FIG. 16A has elasticity in 360 degrees in accordance with the present invention.
Figure 16A:
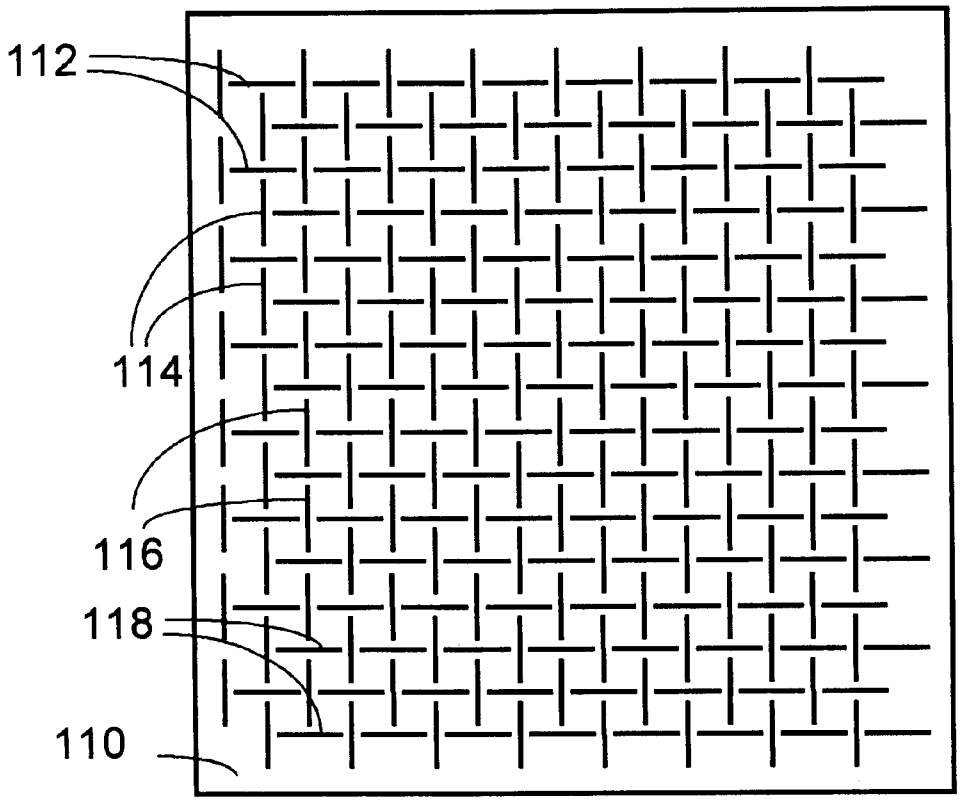
FIG. 16A is a portion of a patterned sheet having a pattern of rows of alternating first and second cuts through the patterned sheet, the first and second cuts being oriented ninety degrees to the second cuts for use in a puncture proof surgical glove in accordance with the present invention.

FIG. 16A is a portion of a patterned sheet 110 having a pattern of rows of alternating first and second cuts through the patterned sheet, the first and second cuts being oriented ninety degrees to the second cuts. In one column of cuts, horizontal cuts 112 alternate with vertical cuts 114. In the next column vertical cuts 116 alternate with horizontal cuts 118. By cutting alternating horizontal and vertical cuts throughout the pattern sheet, elasticity is provided in 360 degrees, as illustrated in FIG. 16B. This pattern can be called a linked square pattern. By layering the linked square pattern sheets into a stacked layer, a puncture proof glove can be provided as described above.

Figure 17B:
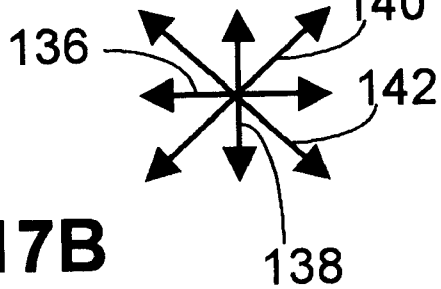
FIG. 17B shows that the patterned sheet of FIG. 17A has elasticity in 360 degrees in accordance with the present invention.
Figure 17A:
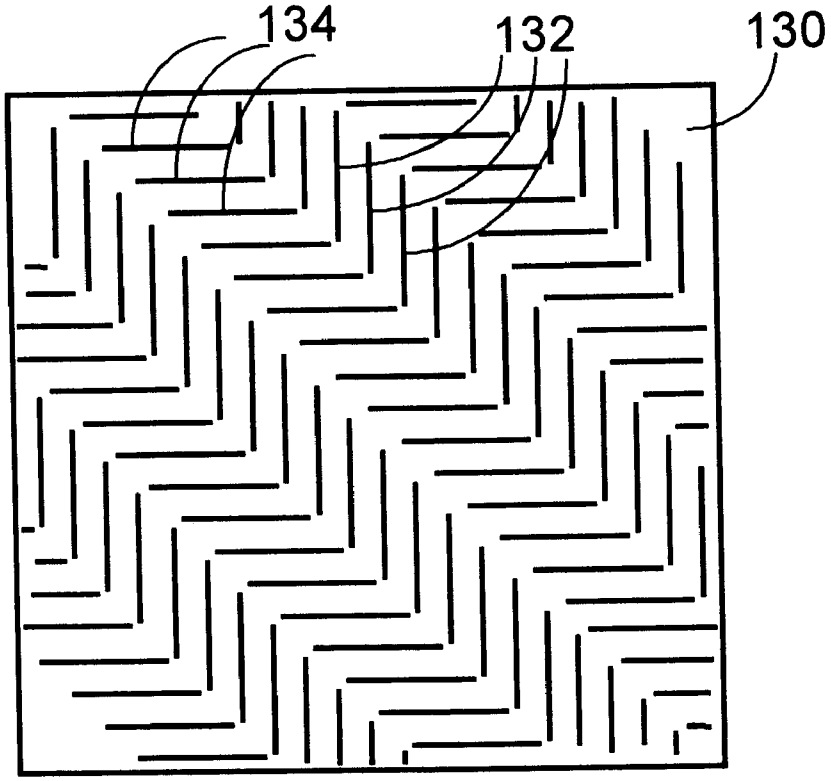
FIG. 17A is a portion of a patterned sheet having a pattern of herringbone cuts through the patterned sheet in accordance with the present invention.

FIG. 17A is a portion of a patterned sheet having a pattern of herringbone cuts through the patterned sheet. Vertical cuts 132 along a diagonal alternate with horizontal cuts 134 along a diagonal. FIG. 17B shows that the patterned sheet of FIG. 17A has elasticity in 360 degrees. This pattern can be called the herringbone pattern. By layering the herringbone pattern sheets into a stacked layer, a puncture proof glove can be provided as described above.

Because linked squares and herringbone patterns have elasticity in all 360 degrees it is not necessary to stack alternate layers in any relative orientation.

Clearly, there are many variations of making cuts in sheets of material to form patterned sheets, including various cut patterns with curves, all of which are within the scope of the present invention.

Figure 18A:
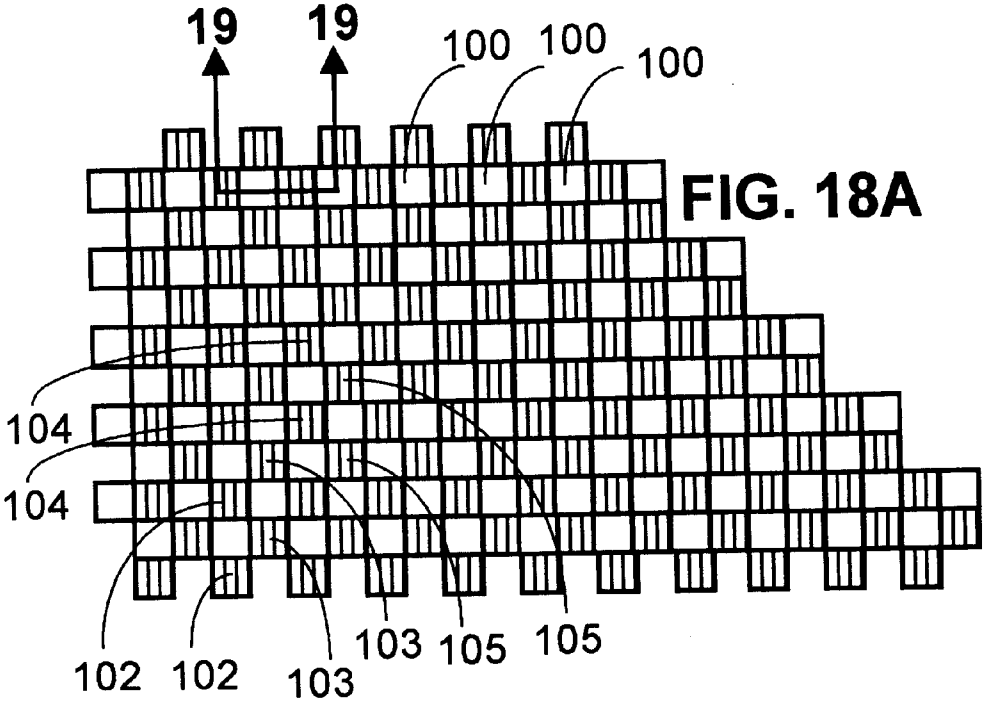
FIG. 18A is a portion of an elastic material formed by weaving strips for use in a puncture proof surgical glove in accordance with the present invention.
Figure 18B:
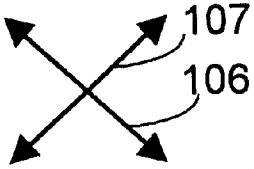
FIG. 18B shows that the woven material of FIG. 18A has elasticity in the 45-degree axis in accordance with the present invention.
Figure 19:
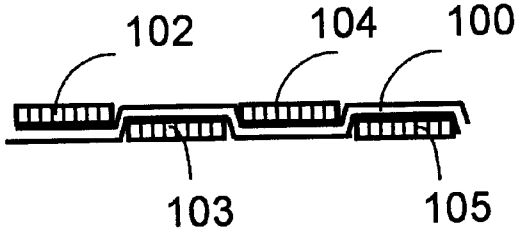
FIG. 19 is a section along line 19—19 of FIG. 18A showing a portion of a material formed by weaving strips for use in a puncture proof surgical glove in accordance with the present invention.

FIG. 18A is a portion of a woven mat formed by weaving strips 100, 102, 103, 104, and 105 of the material used for the patterned sheets above. FIG. 19 is a section along line 19—19 of FIG. 18A. FIG. 18B shows that the woven material of FIG. 18A has elasticity in the 45-degree axis. By layering the woven mats into a stacked layer, a puncture proof glove can be provided as described above.

Various parameters are considered when selecting the type of material for the patterned sheets and woven mats. A key parameter is tensile strength, which in turn dictates the number of patterned sheets in a stacked layer required for a given resistance to puncture. The force of a wounding impact ranges from as little as 5 grams up to 1,000 grams. The optimal target for resistance by the stacked layer is 1,500 to 1,800 grams. The thickness of a single patterned sheet of the material is another factor and for flexibility a thinner patterned sheet is better. The number of patterned sheets in a stacked layer is another factor. For Mylar, up to 60 patterned sheets are required, for Kapton, up to 40 patterned sheets are needed, for metal foil, the number of needed patterned sheets ranges from 6 patterned sheets for ½ mil to 12 patterned sheets for ¼ mil. The width of the elements of the cut pattern is another factor. For a strips pattern, narrow strips are better than wide strips. For example, 1/16-inch wide strips are better for flexibility than ⅛-inch wide strips. As described above the specific pattern used varies the properties of the stacked layer.

Testing has shown that multiple layers of a high tensile strength plastic can provide significant resistance to puncture. This is the "telephone book analogy", which is the proposition that it is not possible to punch an ice pick through a large telephone book. An advancing needle point is stopped when the wedge shape of the needle reaches an equilibrium point where its increasing circumference recruits tensile resistance by the multiple layers of the material. This mechanism would apply to materials such as Mylar and Kapton. The advantage of the plastics is their low cost. The tensile strength of Kapton is 33,000 pounds per square inch (psi), Mylar is 28,000, and metal (steel) is greater than 125,000. Testing of progressively thinner metal foils suggests that metal foil gives a superior performance overall in comparison to the high tensile strength plastics, largely because of the greater tensile strength of metal foil.

Testing of the performance of stacked layers of various materials has been performed. The results are shown below, and confirm that metal foils are superior to conventional plastics.

| Material | # sheets | mils/sheet | total mils | elasticity flexibility |
|---|---|---|---|---|
| Plastic | 60 | ½ mil | 30 | fair |
| Metal foil | 6 | ½ mil | 3 | excellent |
| Metal foil | 12 | ¼ mil | 2.4 | excellent |

There are also new super plastic materials. The DuPont company placed a full page advertisement in a 1999 issue of Scientific American, which describes a new material, SPIDER SILK, which is said to be stronger than steel on a weight basis. If it can be made in thin films, it would be useful for the making stacked layers of the puncture proof glove.

There are two additional factors to consider. One factor is the bulk of the material. That is, with the greater bulk of the plastic, it is restricted in conforming to a small radius, while a thin metal foil is not. With the large number of sheets required for plastics, there is little concern about a needle point finding a "crack" to enter. The plastic stacked layer behaves as if it were one solid piece. While only four patterned sheets of ½ mil metal foil (302/304 stainless steel) are adequate to resist 2,000 grams of force, the use of six patterned sheets for a stacked layer minimizes the chance of a needle finding a void. Using patterned sheets of a very thin metal foil (¼ mil (0.0002 inches)) and twelve patterned sheets in a stacked layer provides excellent puncture resistance. The total thickness of the stacked layer is only 2.4 mils, which provides excellent flexibility. The cuts in the patterned sheets provide the needed elasticity. For comparison, photocopy paper is 6 mil thick.

It should be noted that both the plastic and metal foil configurations can provide protection, differing somewhat in tactile properties and cost of manufacture. Also, plastic may be better suited for a disposable glove considering the cost of materials. Metal foil lends itself to a reusable glove, with on site cleaning and sterilization. Use of a lower cost alloy such as brass for the metal foil would lower the cost and permit a metal foil glove to be a disposable glove.

Figure 20A:
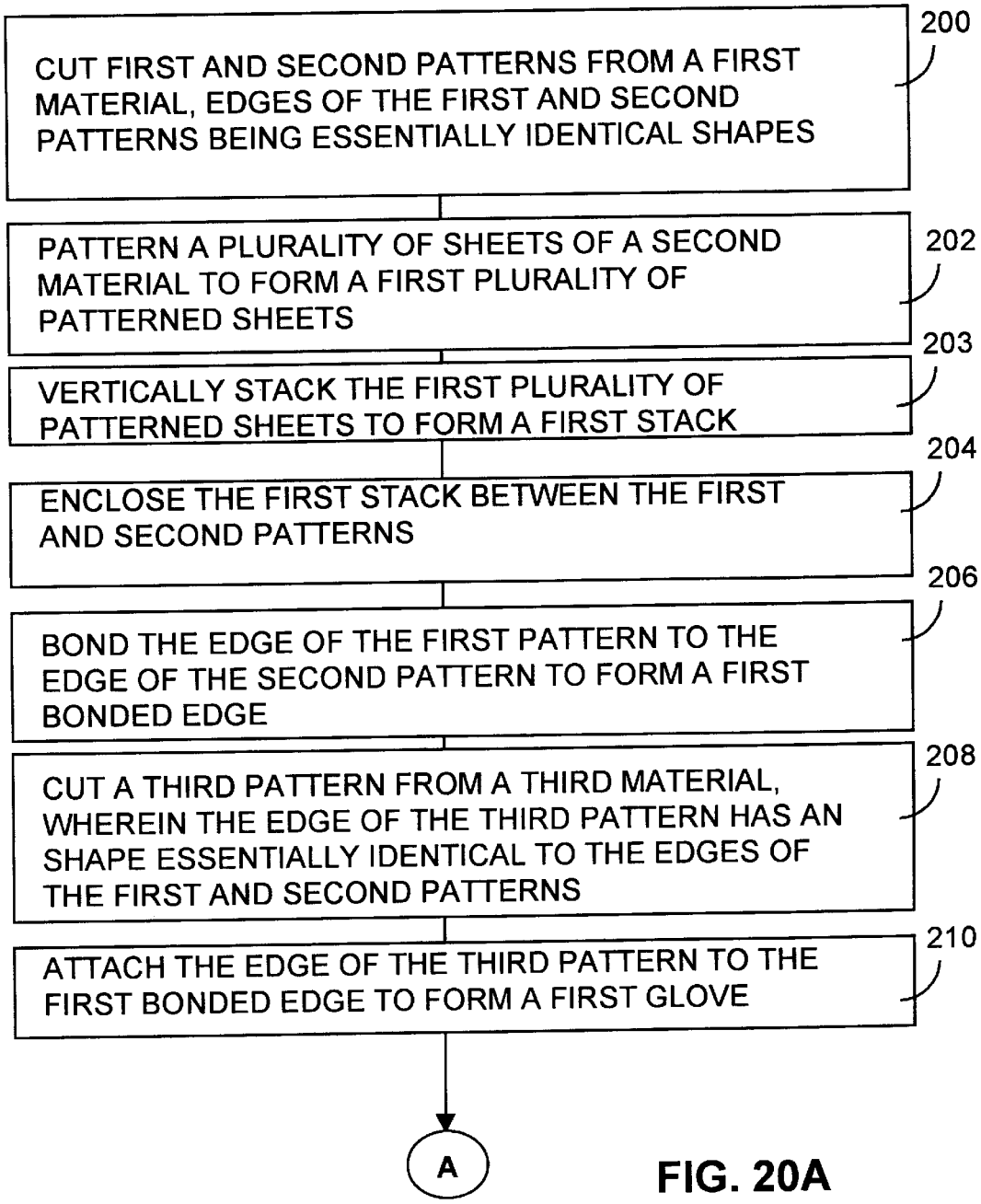
Figure 20B:
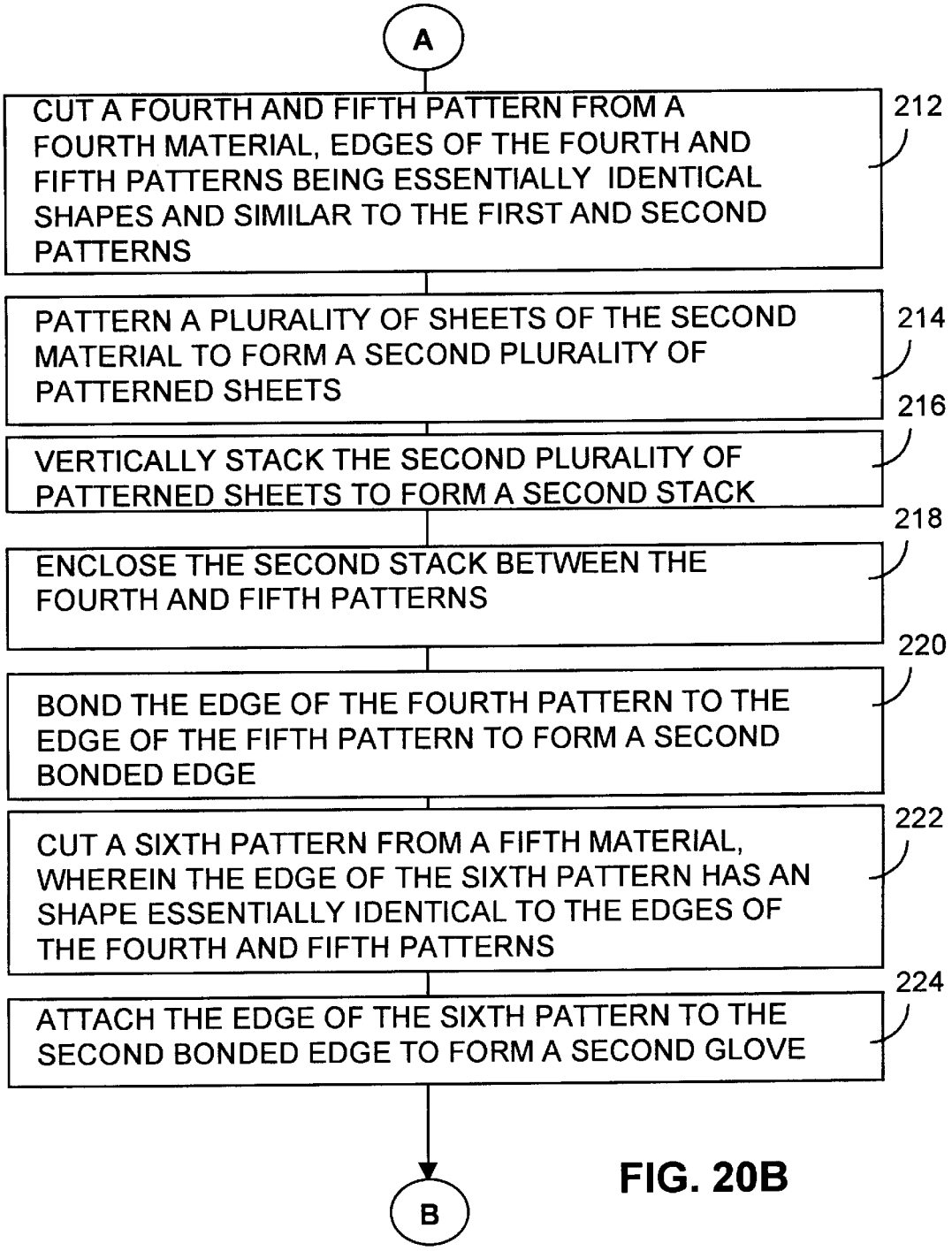
Figure 20C:
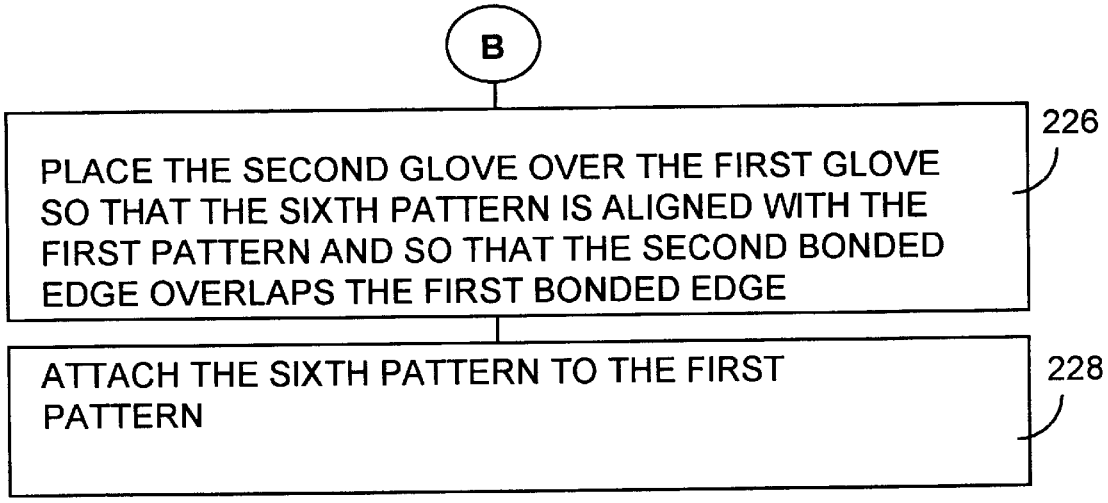

FIGS. 20A, 20B and 20C are methods for producing a puncture proof surgical glove. In step 200 first and second patterns are cut from a first material, edges of the first and second patterns being essentially identical shapes. In step 202 a plurality of sheets of a second material are pattern to form a first plurality of patterned sheets. Then in step 203 the patterned sheet are vertically stacked to form a first stack. Then in step 204 the first stack is enclosed between the first and second patterns and in step 206 the edge of the first pattern is bonded to the edge of the second pattern to form a first bonded edge. Then in step 208 a third pattern is cut from a third material, wherein the edge of the third pattern has an shape essentially identical to the edges of the first and second patterns and in step 210 the edge of the third pattern is attached to the first bonded edge to form a first glove. In step 212 a fourth and fifth pattern are cut from a fourth material, edges of the fourth and fifth patterns being essentially identical shapes and similar to the first and second patterns. In step 214 a plurality of sheets of the second material are patterned to form a second plurality of patterned sheets. Then in step 216 the second plurality of patterned sheets are vertically stacked to form a second stack and in step 218 the second stack is enclosed between the fourth and fifth patterns. In step 220 the edge of the fourth pattern is bonded to the edge of the fifth pattern to form a second bonded edge. In step 222, a sixth pattern is cut from a fifth material, wherein the edge of the sixth pattern has an shape essentially identical to the edges of the fourth and fifth patterns. In step 224 the edge of the sixth pattern is bonded to the second bonded edge to form a second glove. Then in step 226 the second glove is placed over the first glove so that the sixth pattern is aligned with the first pattern and so that the second bonded edge overlaps the first bonded edge. Finally, in step 228 the sixth pattern is attached to the first pattern.

Figure 21:
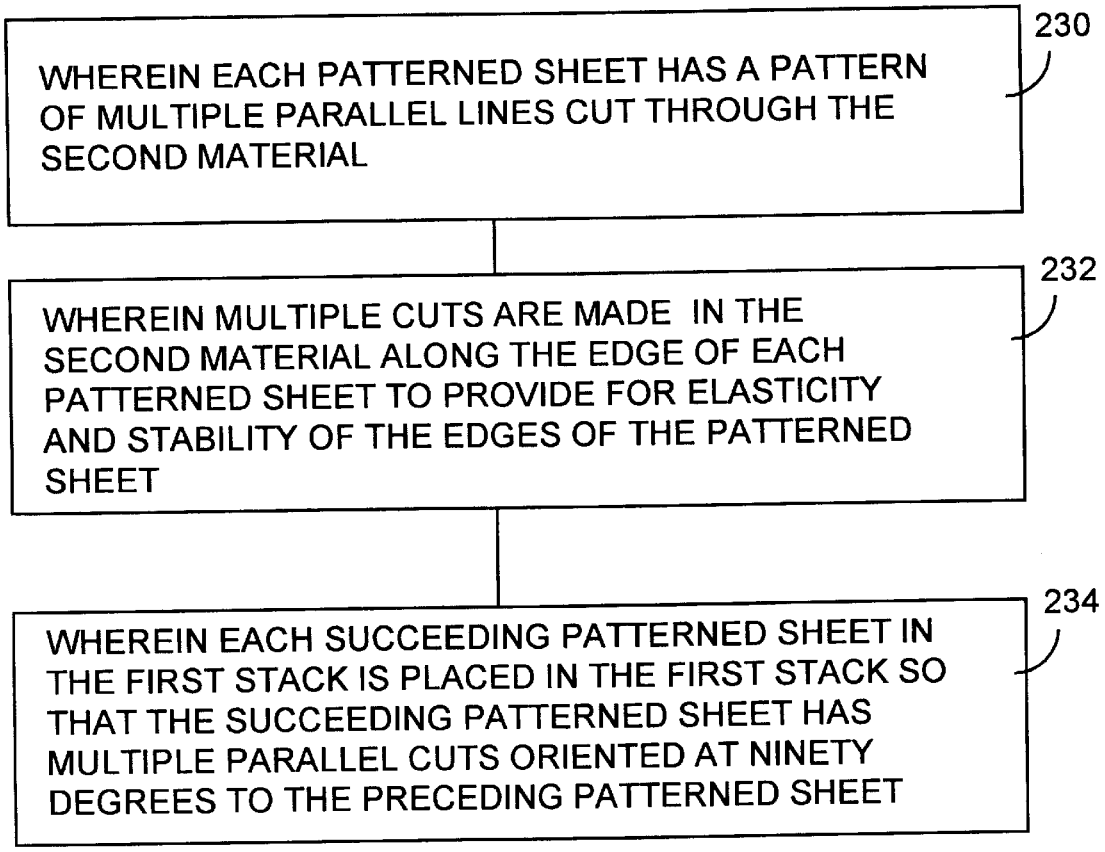

FIG. 21 is the method of FIGS. 20A, 20B and 20C wherein in step 230 each patterned sheet has a pattern of multiple parallel lines cut through the second material, wherein in step 232 multiple cuts are made in the second material along the edge of each patterned sheet to provide for elasticity and stability of the edges of the patterned sheet, and wherein in step 234 each succeeding patterned sheet in the first stack is placed in the first stack so that the succeeding patterned sheet has multiple parallel cuts oriented at ninety degrees to the preceding patterned sheet.

FIG. 22 is the method of FIGS. 20A, 20B and 20C wherein in step 240 each patterned sheet has an alternating pattern of first and second cuts through the second material the first cuts being oriented ninety degrees to the second cuts.

FIG. 23 is the method of FIGS. 20A, 20B and 20C wherein in step 242 each patterned sheet has a herringbone pattern of cuts through the second material.

Figure 24A:
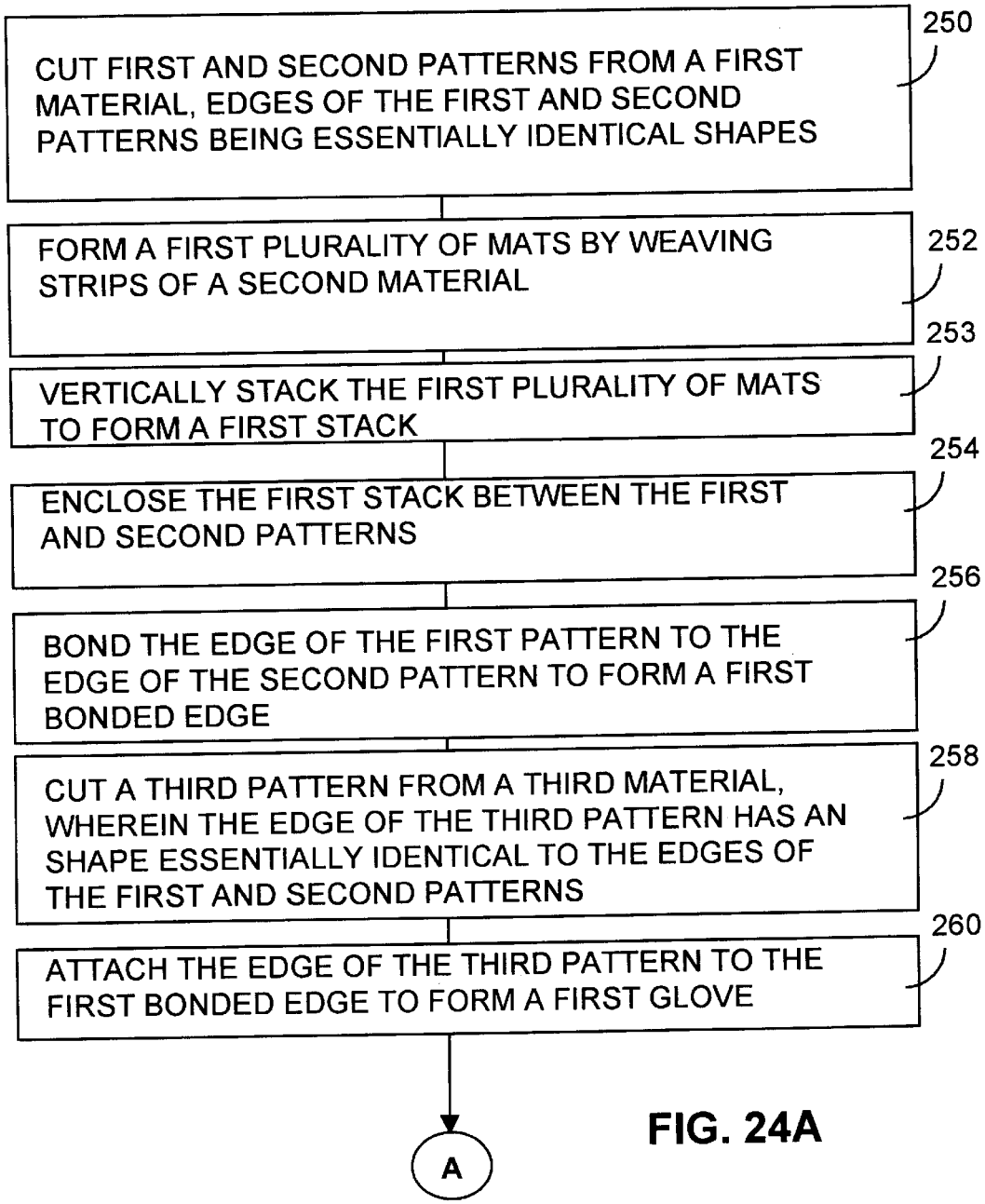
Figure 24B:
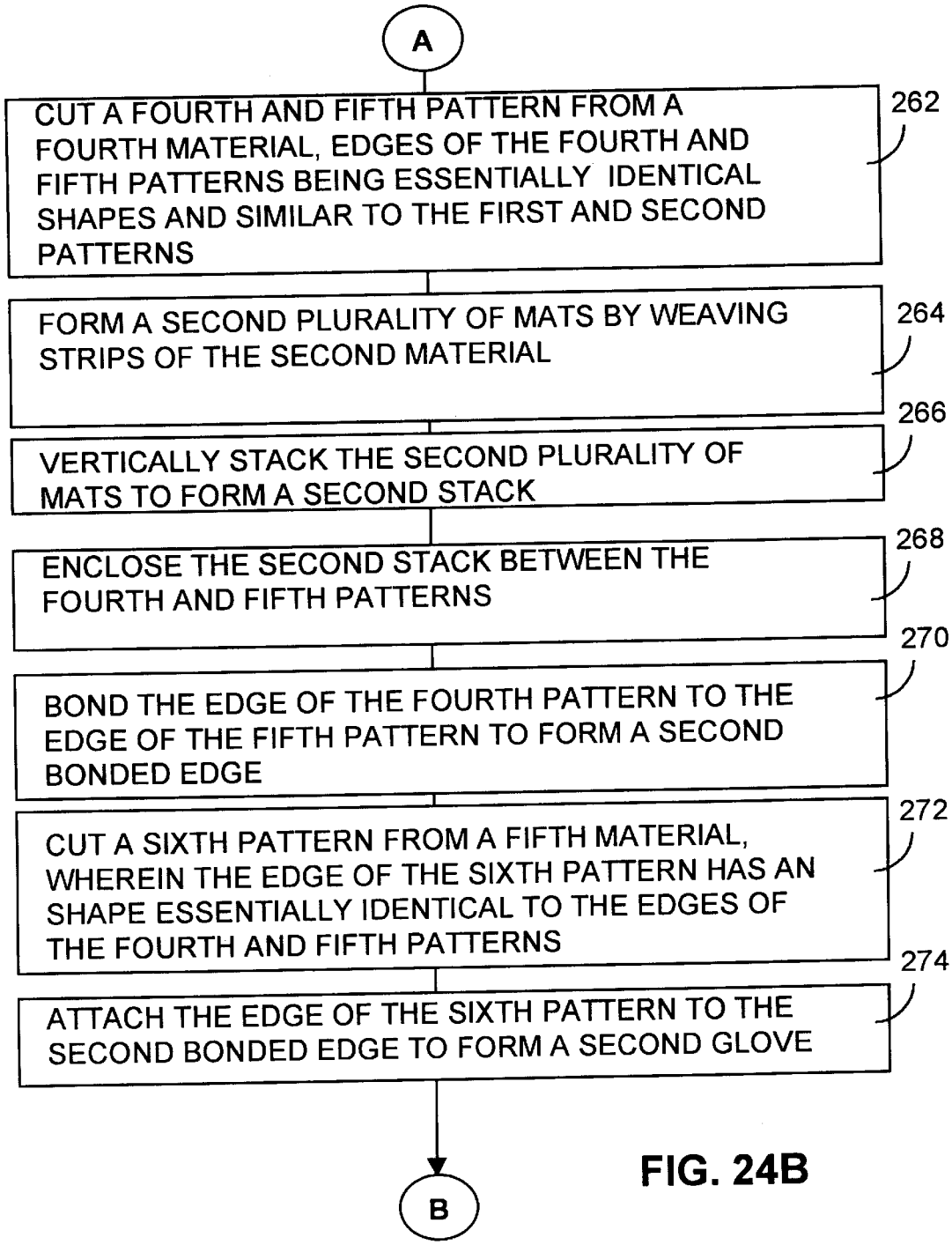
Figure 24C:
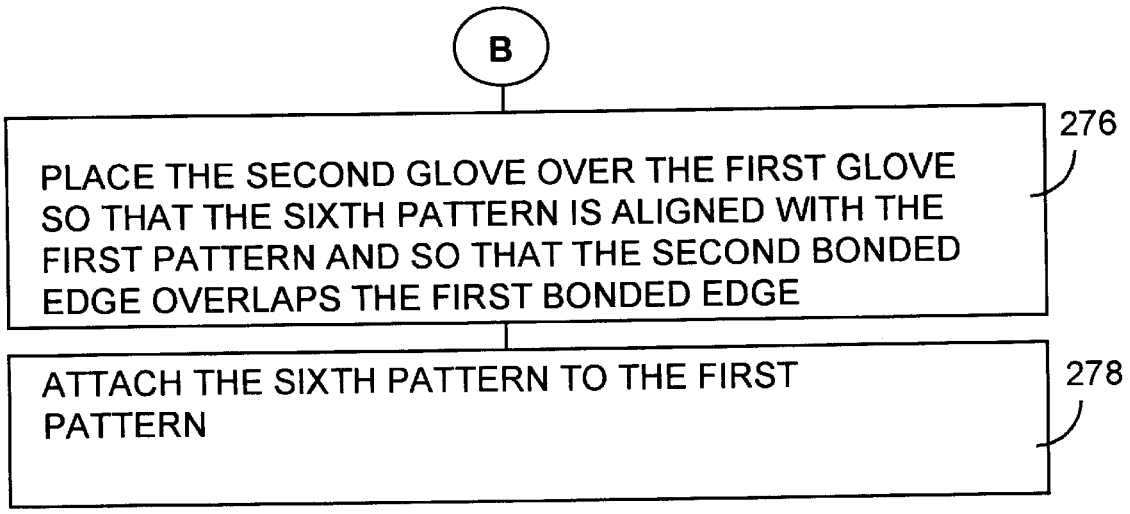

FIGS. 24A, 24B and 24C are methods for producing a puncture proof surgical glove. In step 250 first and second patterns are cut from a first material, edges of the first and second patterns being essentially identical shapes. In step 252 a first plurality of mats are formed by weaving strips of a second material. Then in step 253 the first plurality of mats are vertically stacked to form a first stack. Then in step 254 the first stack is enclosed between the first and second patterns and in step 256 the edge of the first pattern is bonded to the edge of the second pattern to form a first bonded edge. Then in step 258 a third pattern is cut from a third material, wherein the edge of the third pattern has an shape essentially identical to the edges of the first and second patterns and in step 260 the edge of the third pattern is attached to the first bonded edge to form a first glove. In step 262 a fourth and fifth pattern are cut from a fourth material, edges of the fourth and fifth patterns being essentially identical shapes and similar to the first and second patterns. In step 264 a second plurality of mats are formed by weaving strips of the second material. Then in step 266 the second plurality of mats are vertically stacked to form a second stack and in step 268 the second stack is enclosed between the fourth and fifth patterns. In step 270 the edge of the fourth pattern is bonded to the edge of the fifth pattern to form a second bonded edge. In step 272, a sixth pattern is cut from a fifth material, wherein the edge of the sixth pattern has an shape essentially identical to the edges of the fourth and fifth patterns. In step 274 the edge of the sixth pattern is bonded to the second bonded edge to form a second glove. Then in step 276 the second glove is placed over the first glove so that the sixth pattern is aligned with the first pattern and so that the second bonded edge overlaps the first bonded edge. Finally, in step 278 the sixth pattern is attached to the first pattern.

To form the patterned sheets, bulk material in roll form, cut to a width of 6" to 8" can be used. A roller die is laser cut to produce the desired pattern. The cut material roll is then placed on a machine (not detailed here) which makes stacks of the selected number of sheets, in random (+ or −1/32" in the x-y axes) positioning. A second die is configured which cut the layered stack in the shape of a hand outline pattern. This then constitutes the stacked layers 32 and 42 for the inner and outer glove, which can be made identical. The elasticity of the material allows the glove to be made in an "ambi" configuration. That is, it will fit either the right or left hand.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope of the present invention and additional fields in which the present invention would be of significant utility.

It is therefore intended by the appended claims to cover any and all such applications, modifications and embodiments within the scope of the present invention.

What is claimed is:

1. A puncture proof surgical glove comprising:

a first glove comprising:

a first pattern cut from a first material in a first shape;

a first layered stack of a plurality of patterned sheets, each of the plurality of patterned sheets cut from a second material in the first shape and having multiple line cuts through the second material;

a second pattern cut from a third material in the first shape;

a third pattern cut from a fourth material in the first shape;

wherein the first pattern is layered on top of the first layered stack and the second pattern is layered on the bottom of the first layered stack and wherein the first pattern and second pattern are coupled along their edges to form a first coupled edge; and wherein the third pattern is coupled to the first coupled edge along an edge of the third pattern except for a portion of the edge to provide for an opening to an interior of the first glove;

a second glove comprising:

a fourth pattern cut from a fifth material in a second shape;

a second layered stack of the plurality of patterned sheets, each of the plurality of patterned sheets cut from the second material in the second shape and having multiple line cuts through the second material;

a fifth pattern cut from a sixth material in the second shape;

a sixth pattern cut from a seventh material in the second shape;

wherein the fourth pattern is layered on top of the second layered stack and the fifth pattern is layered on the bottom of the second layered stack and wherein the fourth pattern and fifth pattern are coupled along their edges to form a second coupled edge; and wherein the sixth pattern is coupled to the second coupled edge along an edge of the sixth pattern except for a portion of the edge to provide for an opening to an interior of the second glove;

wherein the second glove is placed over the first glove so that the sixth pattern is layered on top of the first pattern;

wherein the second coupled edge of the second glove overlaps the first coupled edge of the first glove; and wherein the first glove is coupled to the second glove to maintain the overlap of the second coupled edge of the second glove and the first coupled edge of the first glove.

2. The puncture proof surgical glove of claim 1 wherein:

the first material, third material, fifth material, and sixth material are a first elastic knit material;

the fourth material and seventh material are a second elastic knit material; and the second shape is adapted to be substantially similar to the first shape and the size of the second shape is adapted to be slightly larger than the size of the first shape to allow the second coupled edge of the second glove to overlap the first coupled edge of the first glove.

3. The puncture proof surgical glove of claim 1 wherein the second material is a plastic.

4. The puncture proof surgical glove of claim 1 wherein the second material is a thin metal foil.

5. The puncture proof surgical glove of claim 4 wherein each of the plurality of patterned sheets cut from the second material in the second shape and having multiple line cuts through the second material comprises a pattern of multiple parallel lines cut through the second material.

6. The puncture proof surgical glove of claim 5 wherein:

each succeeding patterned sheet is placed in the first layered stack to have multiple parallel lines oriented ninety degrees to the preceding patterned sheet in the first layered stack; and each succeeding patterned sheet is placed in the second layered stack to have multiple parallel lines oriented ninety degrees to the multiple parallel lines in the preceding patterned sheet in the first layered stack.

7. The puncture proof surgical glove of claim 4 wherein each of the plurality of patterned sheets cut from the second material in the second shape and having multiple line cuts through the second material comprises a pattern of alternating first and second cuts through the second material, the first cuts being oriented ninety degrees to the second cuts.

8. The puncture proof surgical glove of claim 4 wherein each of the plurality of patterned sheets cut from the second material in the second shape and having multiple line cuts through the second material comprises a herringbone pattern of cuts through the second material.

9. The puncture proof surgical glove of claim 1 comprising the sixth pattern coupled to the first pattern to couple the first glove to the second glove.

10. The puncture proof surgical glove of claim 1 comprising a sterile latex glove placed over the second glove.

11. A puncture proof surgical glove comprising:

a first glove comprising:

a first pattern cut from a first material in a first shape;

a first layered stack of a plurality of mats, each of the plurality of mats woven from strips of a second material;

a second pattern cut from a third material in the first shape;

a third pattern cut from a fourth material in the first shape;

wherein the first pattern is layered on top of the first layered stack and the second pattern is layered on the bottom of the first layered stack and wherein the first pattern and second pattern are coupled along their edges to form a first coupled edge; and wherein the third pattern is coupled to the first coupled edge along an edge of the third pattern except for a portion of the edge to provide for an opening to an interior of the first glove;

a second glove comprising:

a fourth pattern cut from a fifth material in a second shape;

a second layered stack of a plurality of mats, each of the plurality of mats woven from strips of the second material;

a fifth pattern cut from a sixth material in the second shape;

a sixth pattern cut from a seventh material in the second shape;

wherein the fourth pattern is layered on top of the second layered stack and the fifth pattern is layered on the bottom of the second layered stack and wherein the fourth pattern and fifth pattern are coupled along their edges to form a second coupled edge; and wherein the sixth pattern is coupled to the second coupled edge along an edge of the sixth pattern except for a portion of the edge to provide for an opening to an interior of the second glove;

wherein the second glove is placed over the first glove so that the sixth pattern is layered on top of the first pattern;

wherein the second coupled edge of the second glove overlaps the first coupled edge of the first glove; and wherein the first glove is coupled to the second glove to maintain the overlap of the second coupled edge of the second glove and the first coupled edge of the first glove.

12. The puncture proof surgical glove of claim 11 wherein:

the first material, third material, fifth material, and sixth material are a first elastic knit material;

the fourth material and seventh material are a second elastic knit material; and the second shape is adapted to be substantially similar to the first shape and the size of the second shape is adapted to slightly larger than the size of the first shape to allow the second coupled edge of the second glove to overlap the first coupled edge of the first glove.

13. The puncture proof surgical glove of claim 12 wherein the second material is a plastic.

14. The puncture proof surgical glove of claim 12 wherein the second material is a thin metal foil.

15. A method for producing a puncture proof surgical glove, the method comprising the steps of:

forming a first glove, the method for forming the first glove comprising the steps of:

cutting a first pattern from a first material in a first shape;

cutting a plurality of patterned sheets from a second material in the first shape and cutting multiple line cuts through the second material;

forming a first layered stack of the plurality of patterned sheets;

cutting a second pattern from a third material in the first shape;

enclosing the first layered stack between the first pattern and the second pattern;

coupling the first pattern and the second pattern along their edges to form a first coupled edge; and cutting a third pattern from a fourth material in the first shape; and coupling the third pattern to the first coupled edge along an edge of the third pattern except for a portion of the edge to provide for an opening to an interior of the first glove;

forming a second glove, the method for forming the second glove comprising the steps of:

cutting a fourth pattern from a fifth material in a second shape;

cutting a plurality of patterned sheets from the second material in the second shape and cutting multiple line cuts through the second material;

forming a second layered stack of the plurality of patterned sheets;

cutting a fifth pattern from a sixth material in the second shape;

enclosing the second layered stack between the fourth pattern and the fifth pattern;

coupling the fourth pattern and the fifth pattern along their edges to form a second coupled edge; and cutting a sixth pattern from a seventh material in the second shape; and coupling the sixth pattern to the second coupled edge along an edge of the sixth pattern except for a portion of the edge to provide for an opening to an interior of the second glove;

placing the second glove over the first glove so that the sixth pattern is layered on top of the first pattern; and coupling the first glove to the second glove to maintain the overlap of the second coupled edge of the second glove and the first coupled edge of the first glove.

16. The method of claim 15 wherein the step of coupling the first glove to the second glove to maintain the overlap of the second coupled edge of the second glove and the first coupled edge of the first glove comprises the step of coupling the sixth pattern to the first pattern.

17. The method of claim 15 wherein:

the first material, third material, fifth material, and sixth material are a first elastic knit material;

the fourth material and seventh material are a second elastic knit material; and the second material is a plastic.

18. The method of claim 15 wherein:

the first material, third material, fifth material, and sixth material are a first elastic knit material;

the fourth material and seventh material are a second elastic knit material; and the second material is a thin metal foil.

19. The method of claim 18 wherein the step of cutting multiple line cuts through the second material comprises the step of cutting a pattern of multiple parallel lines through the second material.

20. The method of claim 19 further comprising the step of cutting multiple cuts in the second material along the edge of each patterned sheet to provide for elasticity and stability of the edges of the patterned sheet.

21. The method of claim 20 wherein the step of:

forming a first layered stack of the plurality of patterned sheets comprises the step of placing each succeeding patterned sheet in the first layered stack to have multiple parallel lines oriented at ninety degrees to the preceding patterned sheet in the first layered stack; and forming a second layered stack of the plurality of patterned sheets comprises the step of placing each succeeding patterned sheet in the second layered stack to have multiple parallel lines oriented at ninety degrees to the preceding patterned sheet in the second layered stack.

22. The method of claim 18 wherein the step of cutting multiple line cuts through the second material comprises the step of cutting a pattern of alternating first and second cuts through the second material, the first cuts being oriented ninety degrees to the second cuts.

23. The method of claim 18 wherein the step of cutting multiple line cuts through the second material comprises the step of cutting a herringbone pattern of cuts through the second material.

24. The method of claim 15 comprising the step of placing a sterile latex glove over the second glove.

* * * * *